US010815775B2

(12) United States Patent
Lauritzen

(10) Patent No.: US 10,815,775 B2
(45) Date of Patent: Oct. 27, 2020

(54) TRACER INJECTIONS

(71) Applicant: RESMAN AS, Ranheim (NO)

(72) Inventor: Jon Eric Lauritzen, Spicewood, TX (US)

( * ) Notice: Subject to any disclaimer, the term of this patent is extended or adjusted under 35 U.S.C. 154(b) by 0 days.

(21) Appl. No.: 16/082,646

(22) PCT Filed: Mar. 7, 2016

(86) PCT No.: PCT/NO2016/050039

§ 371 (c)(1),
(2) Date: Sep. 6, 2018

(87) PCT Pub. No.: WO2017/155412

PCT Pub. Date: Sep. 14, 2017

(65) Prior Publication Data

US 2019/0100973 A1 Apr. 4, 2019

(51) Int. Cl.

| | |
|---|---|
| ***E21B 47/11*** | (2012.01) |
| ***E21B 27/02*** | (2006.01) |
| ***E21B 43/11*** | (2006.01) |
| ***E21B 23/01*** | (2006.01) |

(52) U.S. Cl.

CPC ..... *E21B 47/11* (2020.05); *E21B 23/01* (2013.01); *E21B 27/02* (2013.01); *E21B 43/11* (2013.01)

(58) Field of Classification Search
None
See application file for complete search history.

(56) References Cited

U.S. PATENT DOCUMENTS

2007/0241277 A1* 10/2007 Stray ..... C09K 8/03 250/303
2016/0230543 A1* 8/2016 Borrell ..... C09K 8/03
2018/0298277 A1* 10/2018 Borrell ..... C09K 8/035

FOREIGN PATENT DOCUMENTS

GB 1507479.2 * 4/2015 ..... C09K 8/92

* cited by examiner

*Primary Examiner* — Andrew Sue-Ako
(74) *Attorney, Agent, or Firm* — Birch, Stewart, Kolasch & Birch, LLP

(57) ABSTRACT

The invention is a petroleum well tracer injection and monitoring method comprising the steps of providing a one or more curable liquid doped with one or more tracer, arranging said one or more liquid in an intervention liquid injecting tool, running the injection tool into a production tubing in a petroleum well to one or more desired injection position along the tubing, actuating the injection tool to apply one or more portions of the tracer doped liquid at said one or more desired positions, each said portion deposited to form a material deposition at a tubing wall of said tubing, allowing the well to produce and monitoring the tracers in the production flow and a tool to perform the injection.

28 Claims, 13 Drawing Sheets

Figure 1:
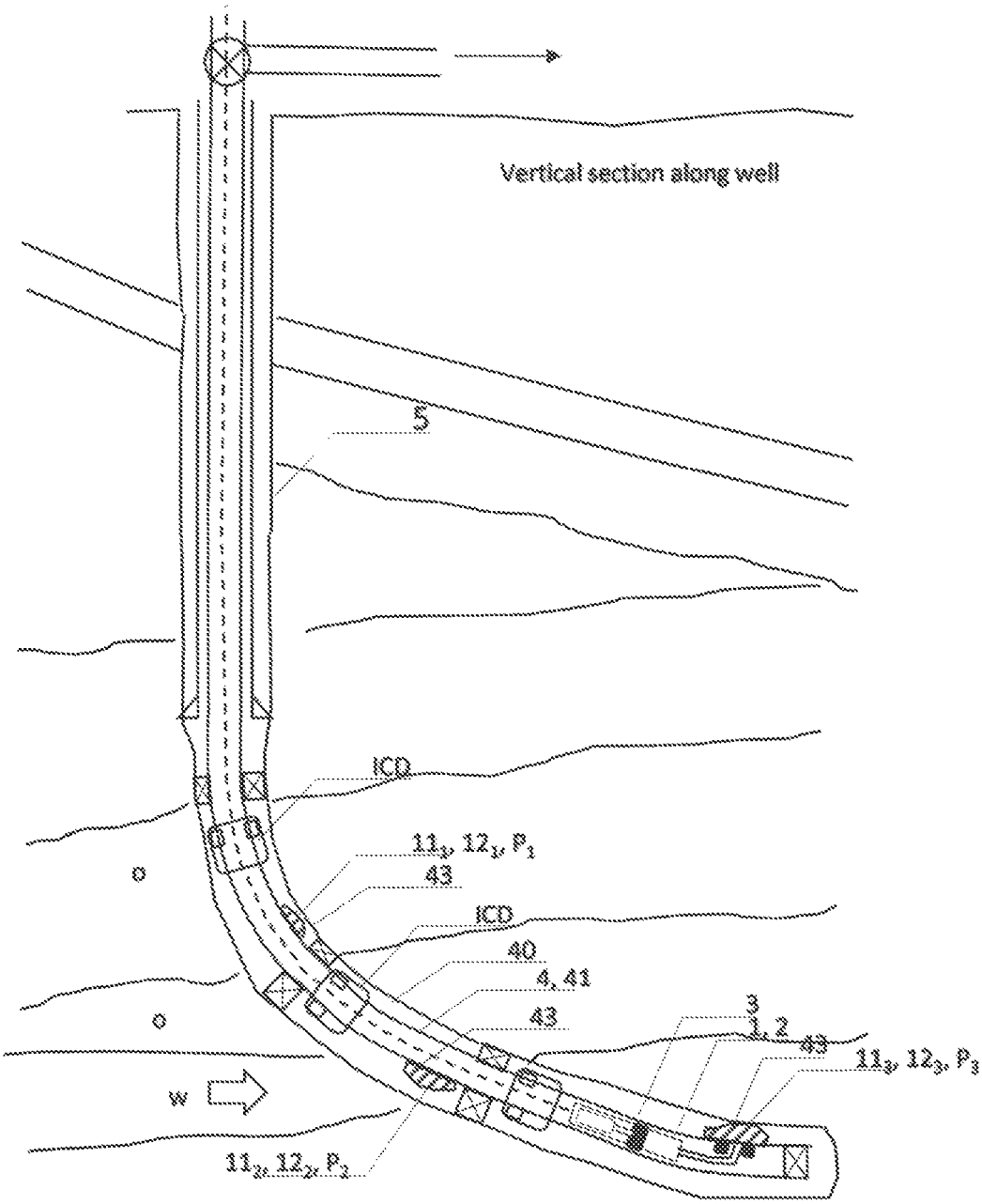

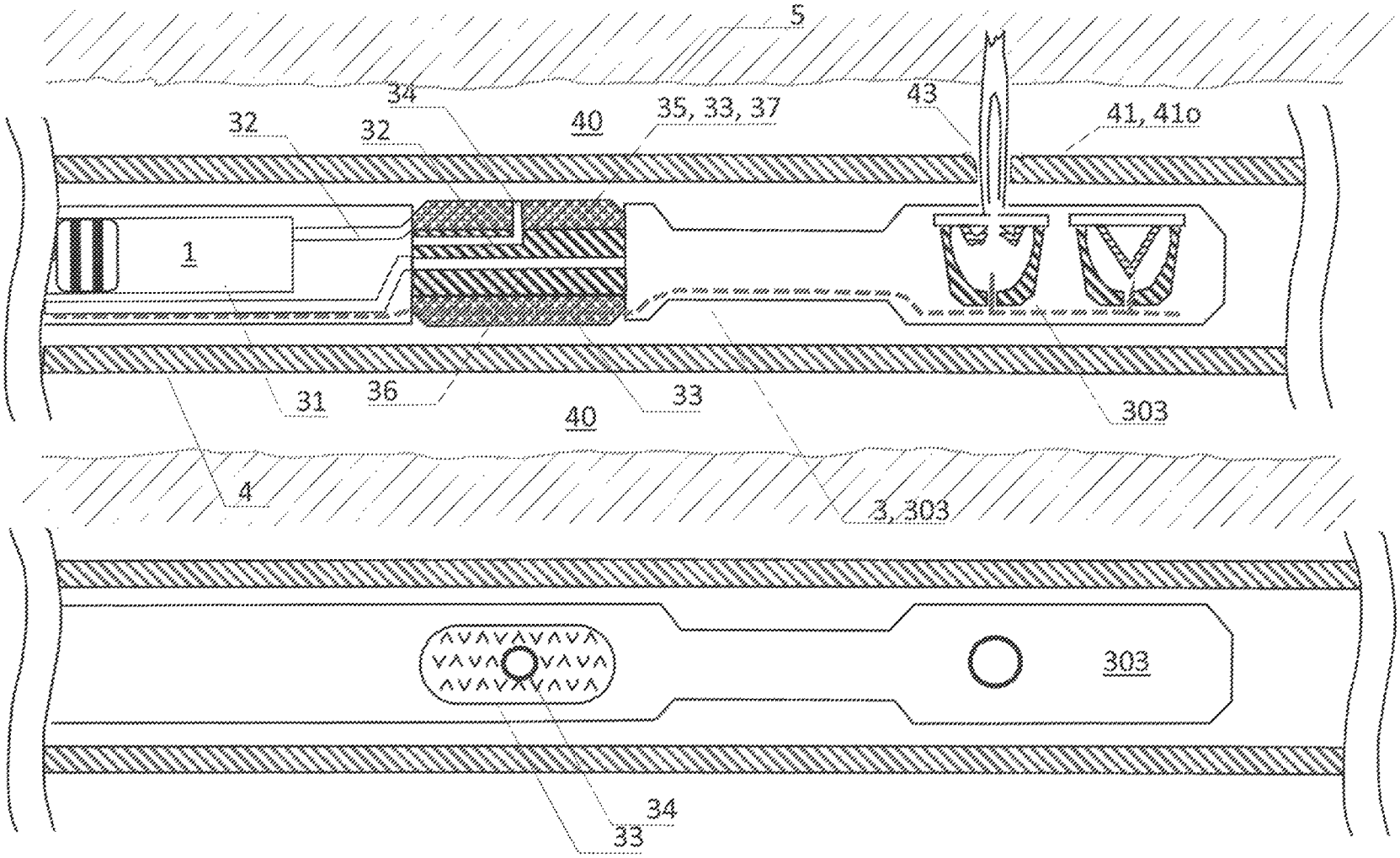
Fig.2a: Vert. sect. of part of prod. liner (4) in well (5) w/ comb. inj. and perf. tool (3, 303).
Fig.2b: Hori. sect. of part of the production liner (4) in well (5) with comb. inj. andperf. tool (3, 303).

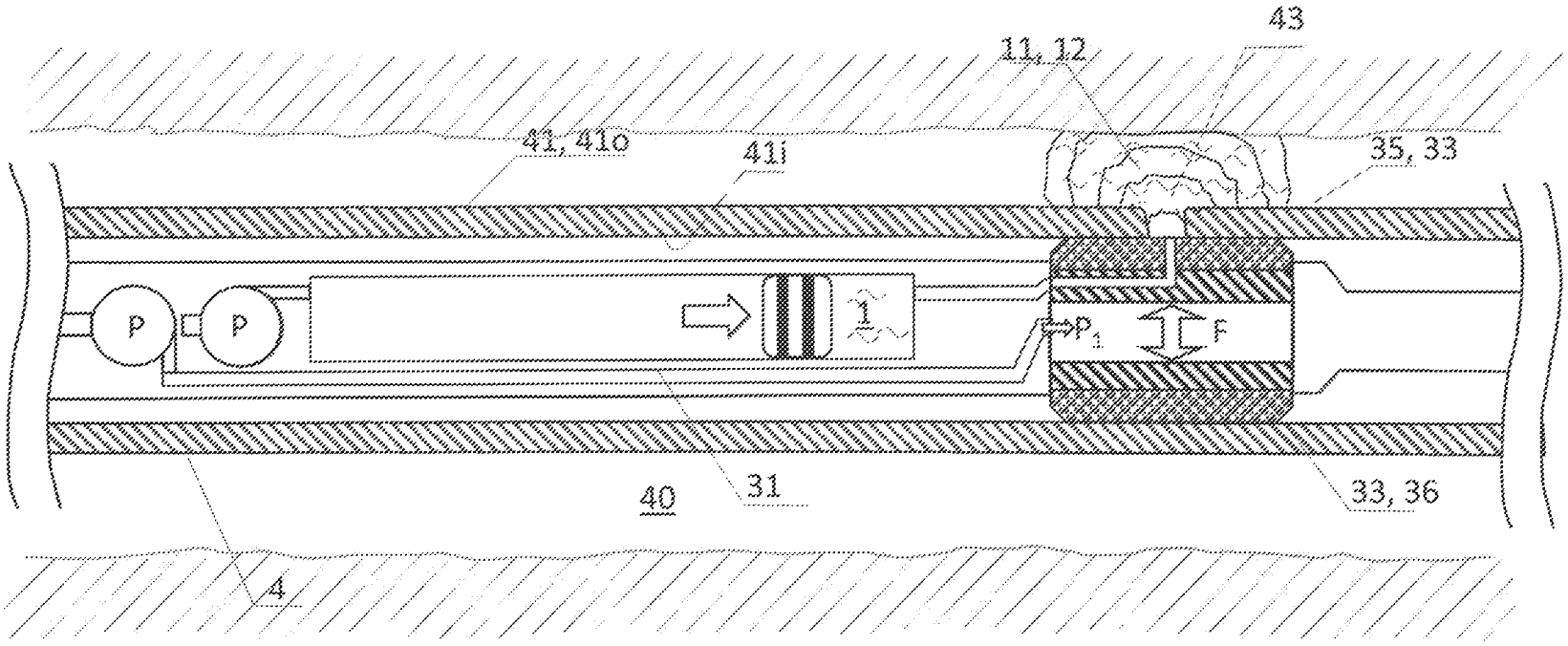
Fig. 3: Vertical section corresponding to the tubing (4) section of Fig. 2a.
Vertical section injection, of fluid (11) after perforating.

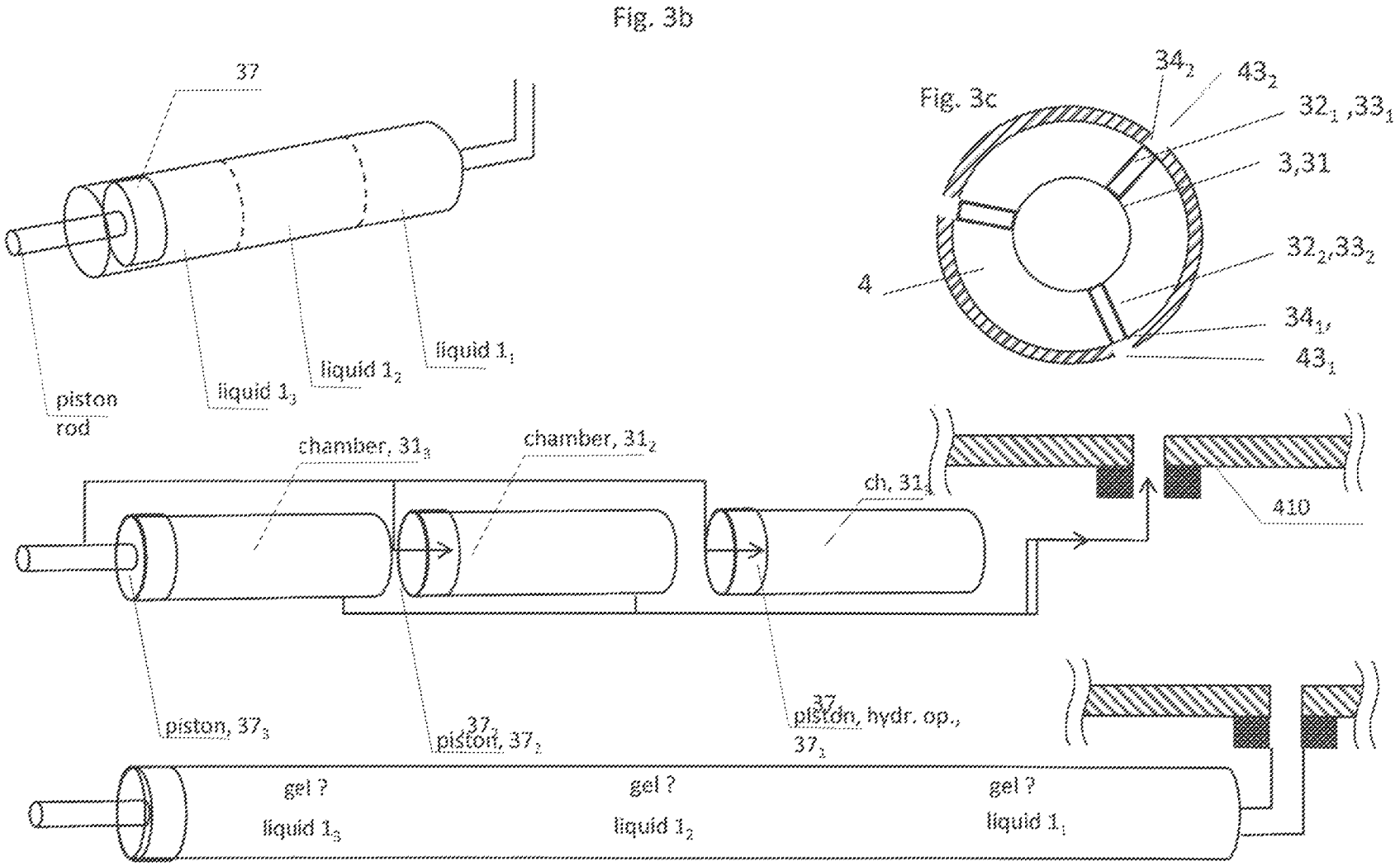
Fig. 3b: Longitudinal section of an injection tool comprising multiple polymer liquid containers (31, 31i).

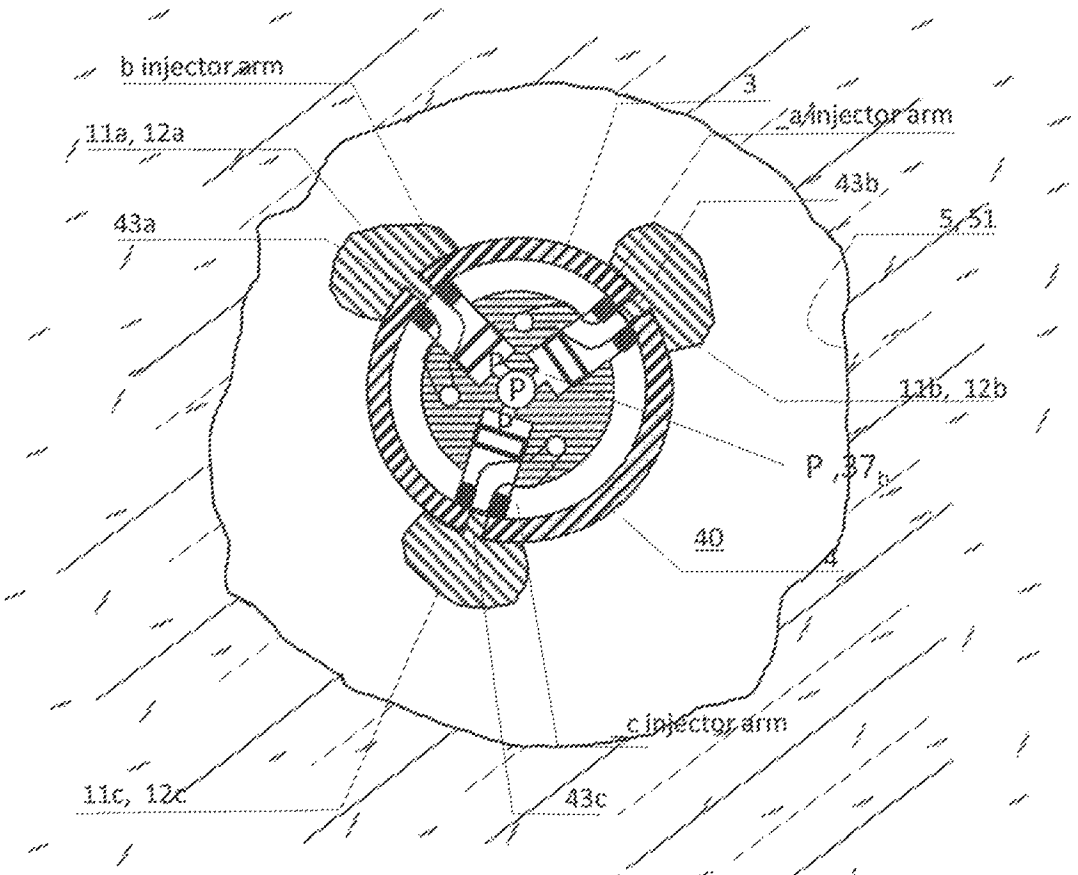
Fig. 5: circumferentially distributed deposits (12) formed around on the outer surface (41o) of the tubing (4), and a cross-section
Three (or two) deposits (12) formed with 3x120 or 2x180 degrees angular orientation about the tubing axis.
Further development: orientation of each known distinct, w, o, or N tracer is known.

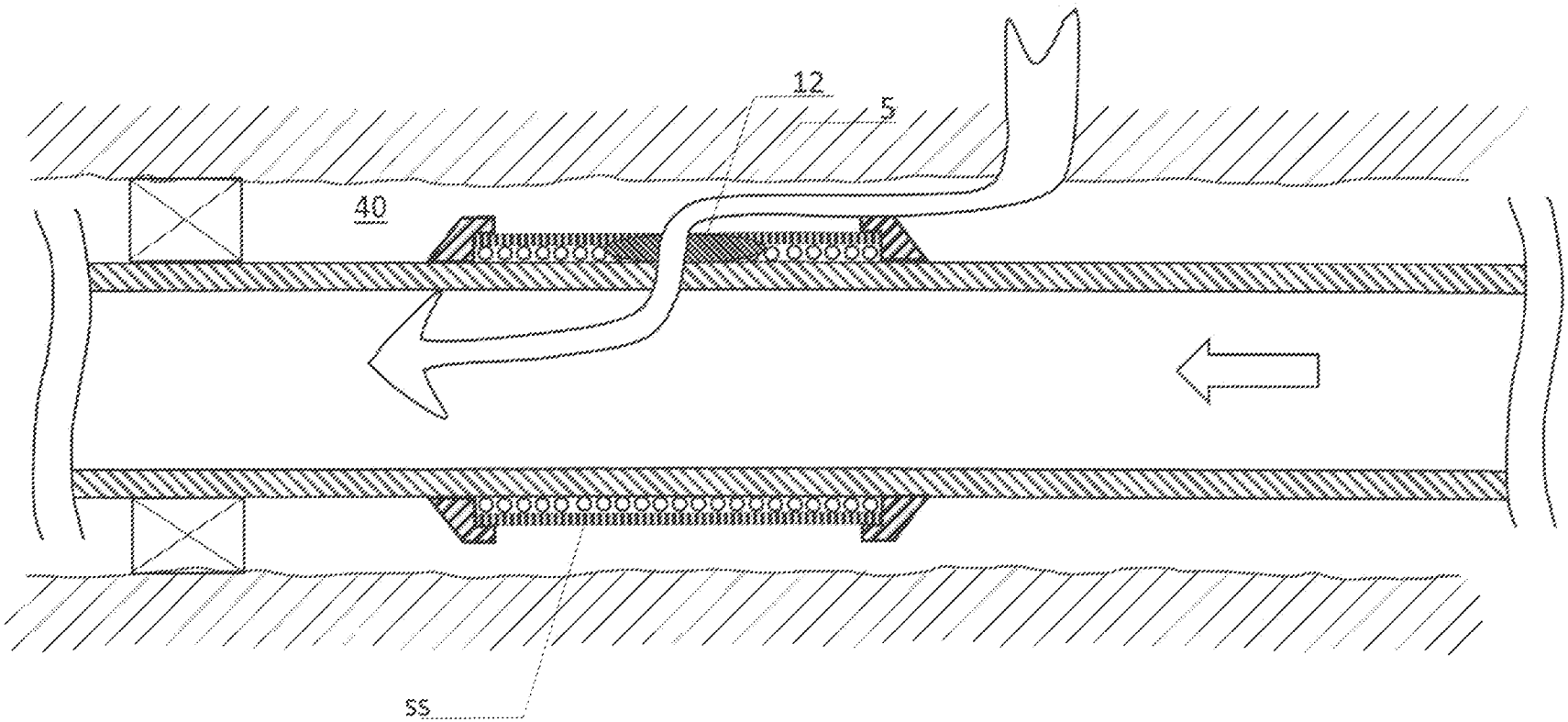
Fig. 6: Tracer deposit within a sand screen mesh without having to perforate any tubing.

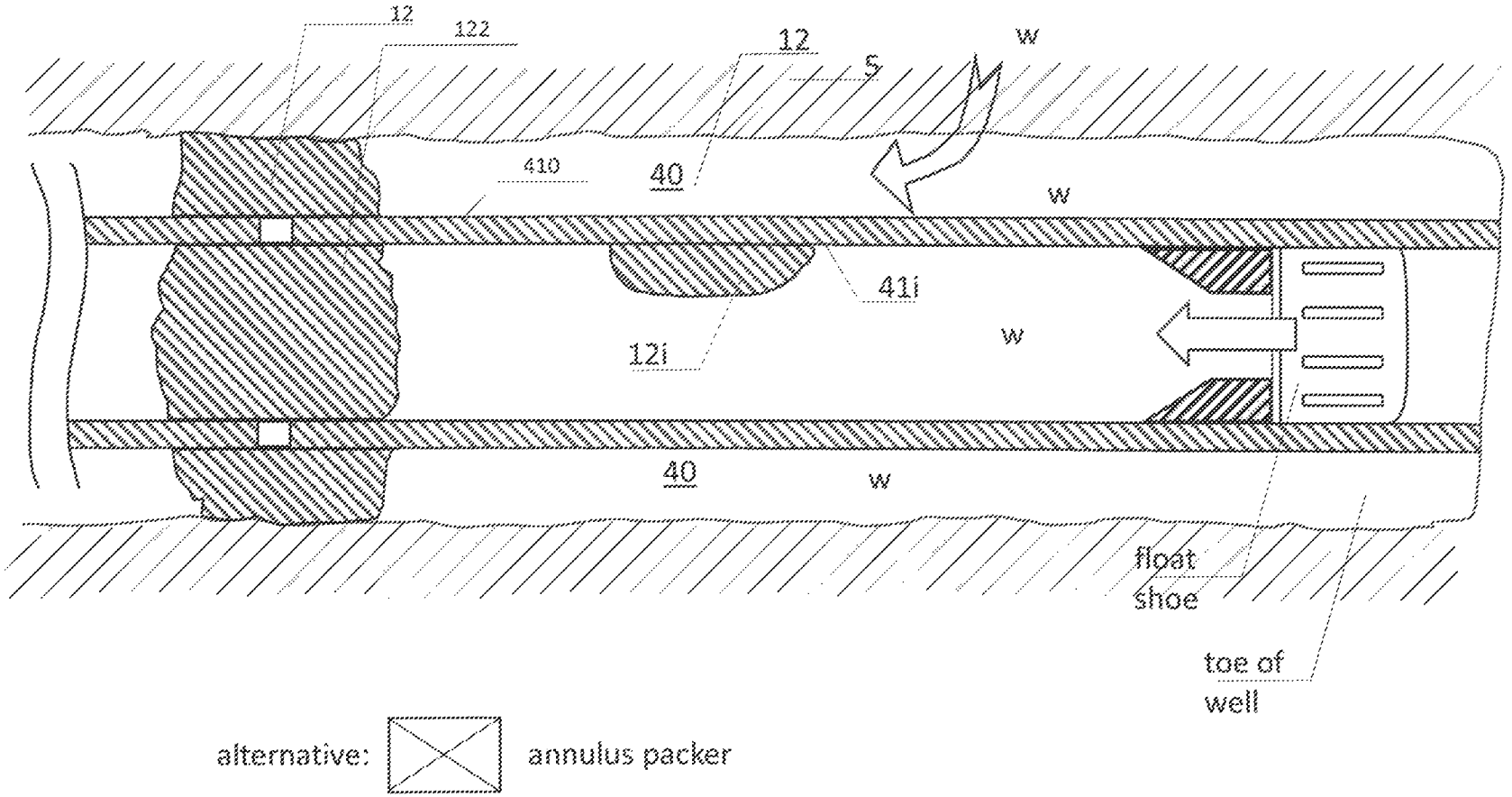

Fig. 7: Shut off of the toe (the innermost part of the well) by placing a tracer deposit Tr(i) on the wall within the toe portion to be isolated, then forming an annular-filling deposit in the annulus, and finally forming a full-bore deposit plug to shut off the toe.
Test: if Tr(i) is detected downstream of the plug deposit, the central bore plug has failed; then water intrusion in the toe has started leaking further downstream past the plug

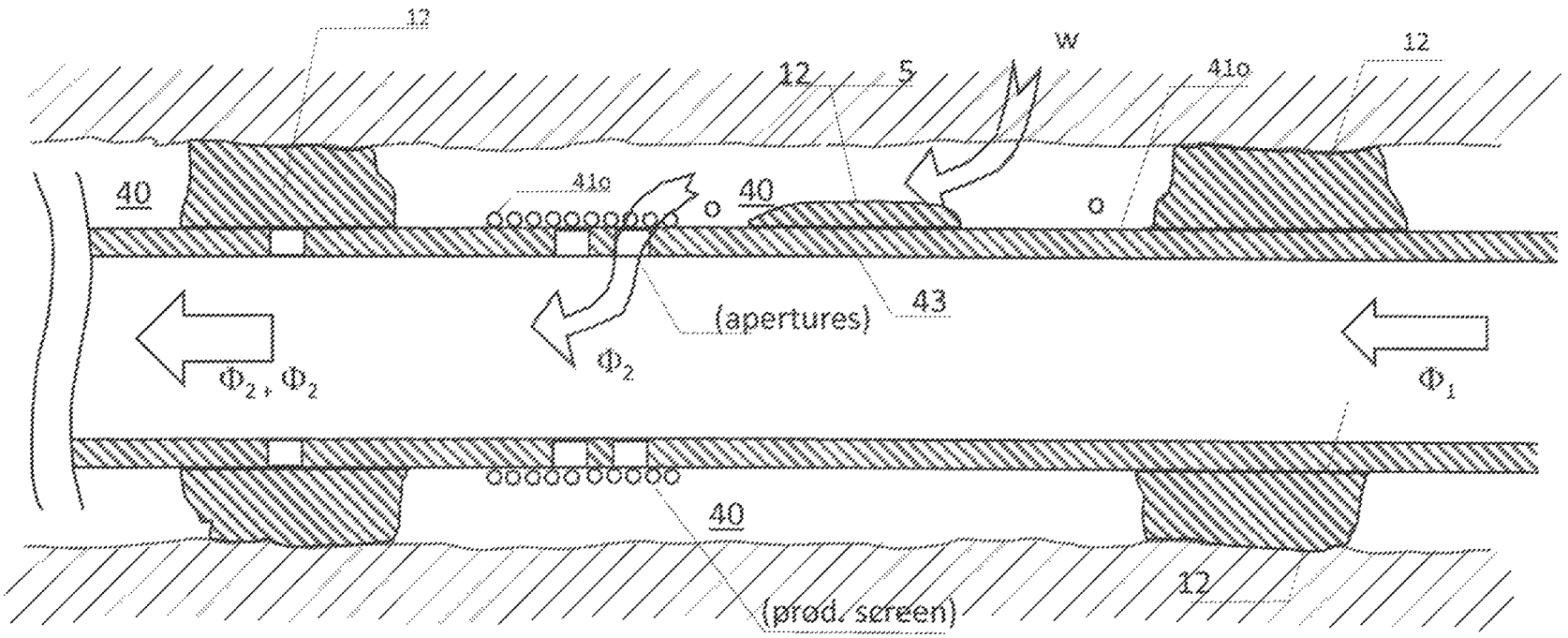

Fig. 8: Deposit within isolated oil influx chamber: Delay chamber formed which may be used accordingly. Production from zonal isolated tracer. Only gas or oil influx is desirable. Zonal isolation and placing tracer between packers. The packers may be formed using the present tool, and one may mark each packer, particularly the downhole packer, with a tracer, too, or form non-tracer packers.

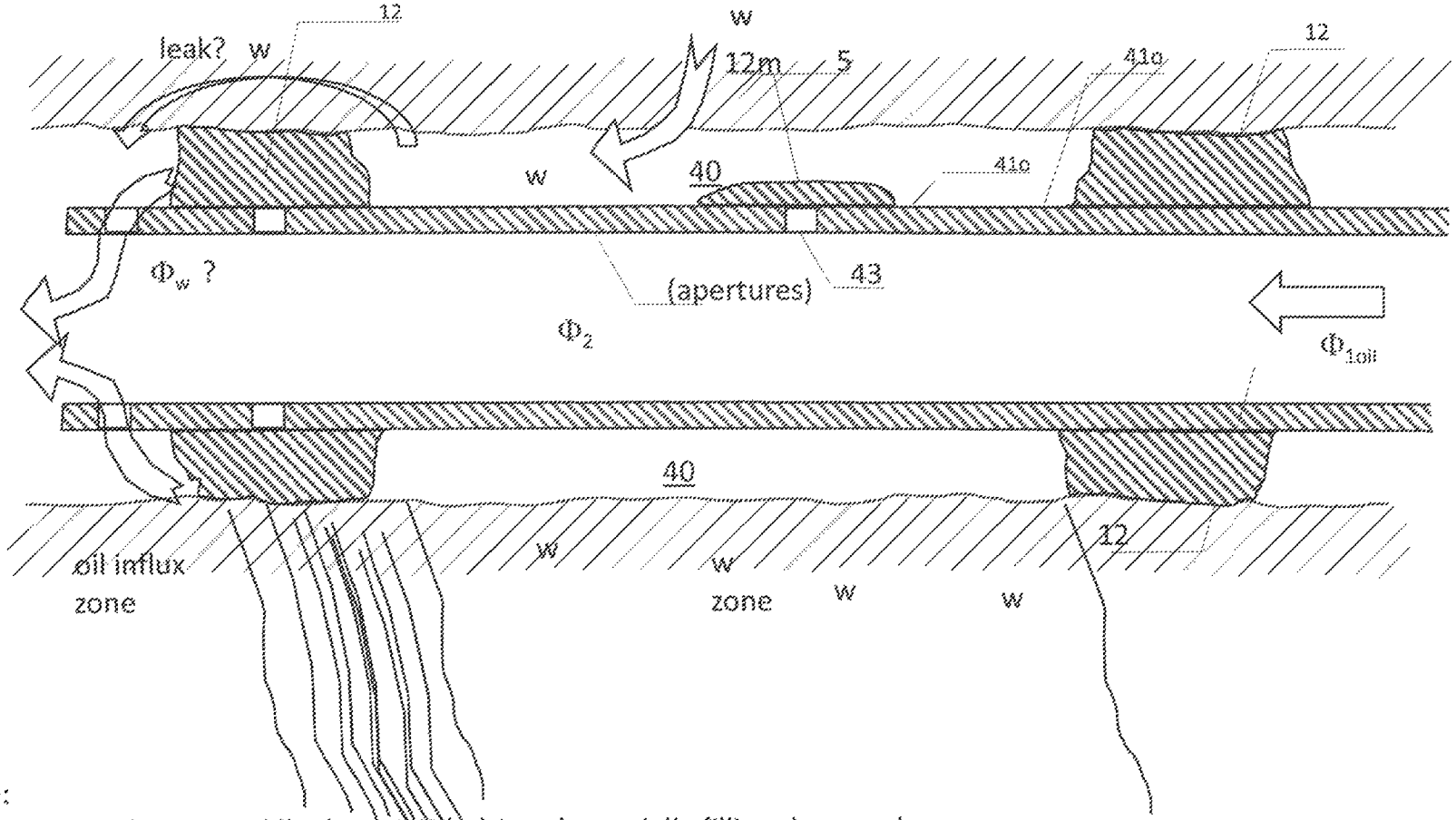

Fig. 9:
Water zone isolation: Middle deposit Tr(m) is only partially filling the annulus.
If the Tr(m) is detected downstrem, there is a leakage problem. This may occur if there is a leakage across the packer or via a crack or permeable rock which bypasses the downstream packer. If the downstream packer tracer Tr(d) is detected downstream, then OK as such. This may be used to check whether the deposit formed is actually isolated within the influx chamber:

TRACER INJECTIONS

PRIORITY APPLICATIONS

This application is a U. S. National Stage Filing under 35 U.S.C. 371 from International Application No. PCT/NO2016/050039, filed on 7 Mar. 2016 and published as WO/2017/155412 on 14 Sep. 2017, which application and publication are incorporated herein by referenced in their entirety.

The present invention relates to the technical field of installation and monitoring tracers in a petroleum production well. More specific the invention is a method for placing tracers by applying a curable liquid doped with tracers in desired positions in an already completed production well and a tool for conducting the method.

BACKGROUND ART AND PROBLEMS TO BE SOLVED

Today tracers are deployable in new wells, but presently no viable solution has been matured for retrofit applications to place tracers in the annulus of an existent completion. Short summary of the invention Today tracers are installed in wells as a subsystem of the well architecture, deployed on/in the well equipment when the well is initially constructed. For example, tracers are deployed in sand screens, or in carriers specifically designed for holding the tracers. These tracer systems are deployed as part of the completion, at the time of initial installation. From such systems one may gather information about the total flow in the pipeline and the partial flow from the specific zones where the tracers are placed. All based on type of tracer and the design of the tracer installation system For installation of tracers into the formation one may shoot the tracers into the formation using explosives. This is made prior to completion.

Injection to the formation is also an alternative by a tool lowered into an uncompleted well and tracers are injected directly into the borehole wall. This is also a "prior to completion"-method When it comes to installation of tracers into completed producing wells there are only a few possibilities. Tracers may be pumped into the formation via an injection well. This will give less information, limited to information about the flow from this injection well, and generally the tracers will have a long residence time.

Methods for pumping tracers directly into the pipeline and directly to the flow are available but such methods are not for fixed placing of a tracer source. The injection, production and sampling will take place more or less without any delay, i.e. for the flow wherein the tracers was pumped. The tracer will follow the production flow in which it is injected.

U.S. Pat. No. 9,045,975 B2 describes a method for annular isolation. The annular plug provides a durable seal after being injected and placed at the predefined location. The method allows a designer epoxy to be deployed downhole to provide a durable annular seal. The tool is designed to go down the well and, at the selected point, make holes with perforation charges and inject liquid epoxy which then hardens, forming annular epoxy plugs. The annular epoxy plugs may be installed to direct fluid flow in the well. The tool brings epoxy down the well in sealed canisters, perforates the liner, orientates injection pads around the perforations and squeezes epoxy behind the liner. The epoxy forms a solid plug in the annulus behind the liner, providing annular isolation.

BRIEF SUMMARY OF THE INVENTION

The invention solves the problems stated above and is a petroleum well tracer injection monitoring method comprising the steps of

- providing a one or more curable liquid doped with one or more tracer
- arranging said one or more liquid in an intervention liquid injecting tool
- a)—running the injection tool into a production tubing in a petroleum well to one or more desired injection positions along the tubing
- b)—actuating the injection tool to apply one or more portions of the tracer doped liquid at said one or more desired positions, each said portion deposited to form a material deposition at a tubing wall of said tubing
- allowing the well to produce
- monitoring the tracers in the production flow
- analysing the occurrence of tracers qualitatively and/or quantitatively and then
- acting on the basis of the analysis. An advantage of the method is that one may install tracers into the tubing and/or annulus after the well has been completed. The tracers may also be installed after a time of production and based on information from well analysis carried out after a time of production, as well. This gives the possibility of very well designed tracer sources for placing at particular inflow zones etc. The method enables placement of the tracers in discrete zones which enables qualitative verification and quantification of flow from each zone. The method does not require placement of any permanent equipment into the wellbore. The process ensures future access to the well, enabling repeatability, assuming tracer life has expired, or if zones are modified.

The invention is also an intervention tracer injecting tool for placing of one or more tracers sources to one or more desired injection positions along a production tubing in a petroleum well comprising

- one or more liquid containers with
- one or corresponding liquid outlets and
- an injection tool
- actuator means arranged for activating
- one or more delivery manipulators for delivering portions of a tracer doped liquid forming tracer the tracer sources at the desired positions and/or to different sectors of the circumference of the tubing. Advantages is that the tool can carry one or more tracer sources, and by a single intervention

FIGURE CAPTIONS

The attached figures illustrate some embodiments of the claimed invention.

FIG. 1 is a vertical section along a petroleum well (5) with at least one casing extending from the surface and a completion comprising a zone-isolated production tubing (4) extending at least from the lower part of the casing and into the "toe"; the innermost portion of the drilled well. In the embodiment shown the well is deviated from the vertical in order to have near-horizontal zones in geological layers where fluid influx from oil, gas may occur. Water (w) may occur in part of the zones. Material depositions (12) on the tubing wall are made according to the invention by injection of tracer-doped fluid (1) portions (11) to the outside of the tubing (4). The depositions may be made in different positions (P1, P2, P3, . . . ) along the well. FIG. 2 illustrates two orthogonal longitudinal sections and views along the tool and its intended use in a well, which is also shown in longitudinal section.

FIG. 2*a* is a vertical section of the combined perforation and injection tool (3, 303) wherein a first perforation gun is positioned with a perforating charge at a desired position (P) along the well, and fired to make a perforation (43) in the liner/production tubing/production liner (4). The injection tool portion (3) is arranged with a separation stem connecting it to the perforation gun portion, and usually not to be activated until the perforation gun has made a perforation (unless access to the annulus is available, e.g. in the situation wherein one shall inject tracer material depositions into a production screen, please see FIG. 5).

FIG. 2*b* is an orthogonal cross section of the well and the same casing, and a view of the tool showing the fired perforation gun (303) and a first wall contact pad of a wall engaging arm (33) with an aperture (34) to be aligned with the perforation (43) made in the position shown in FIG. 2*a*, please see FIG. 3.

In order to enable repositioning of the engaging arm's (33) aperture (34) to the position where the perforation (43) was made, in an embodiment the combined perforation and injection tool (3, 303) is provided with an anchor (96) and a stroker (97) for anchoring the combined tool (3, 303) before perforation and moving the aperture (34) to the perforation (43). In another embodiment, the combined perforation and injection tool (3, 303) is borne on a tractor (98) for positioning the combined tool (3, 303) before perforation and moving the aperture (34) to the perforation (43). In another embodiment, the tool can be deployed on coiled tubing or jointed pipe (not illustrated).

Figure 2C:
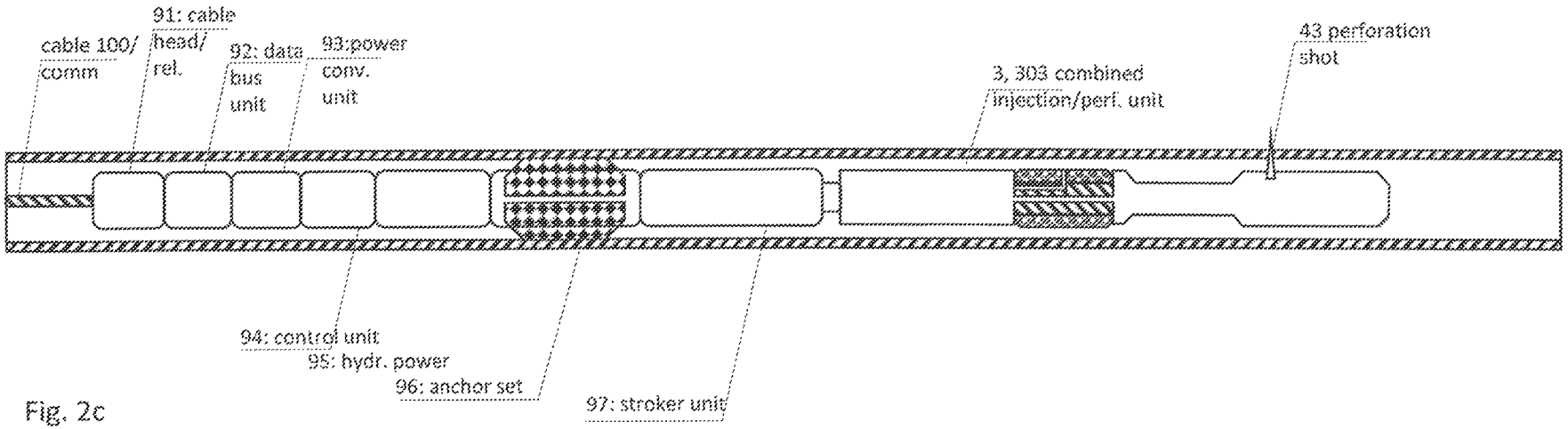

FIG. 2*c* is an illustration of a tool string on a cable (100), the tool string comprising a cable head and release unit (92), a data bus unit (92), an electrical power conversion unit (93), a tool control unit (94), a hydraulic power unit (95), a here shown anchored anchor unit (96), a stroker unit (97), and the combined injector and perforation unit (3, 303) whereof the perforation unit (303) has made one perforation.

Figure 2D:
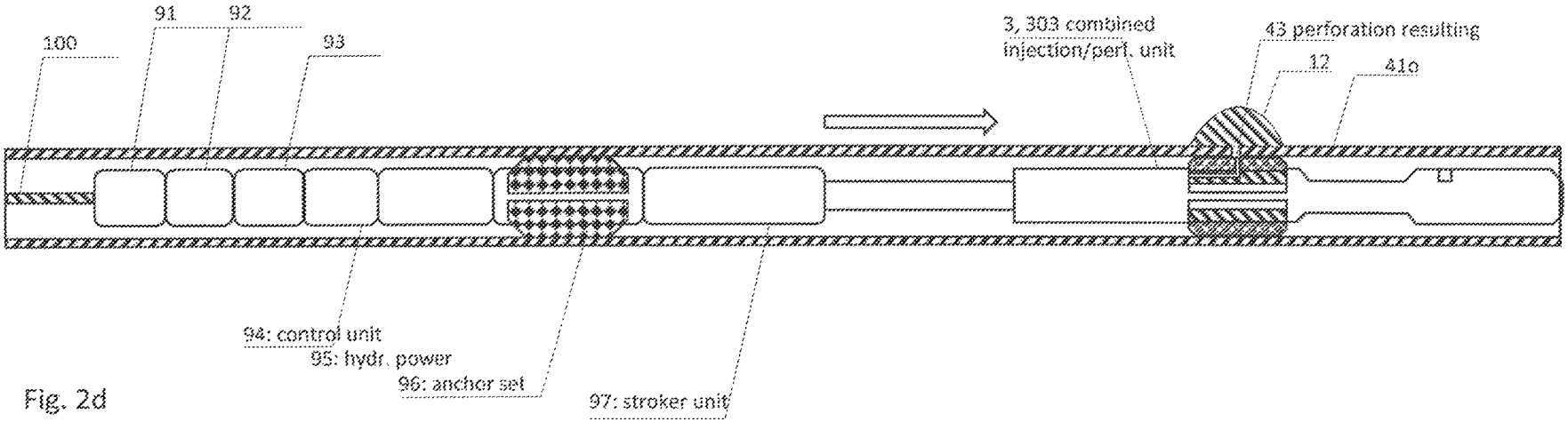

FIG. 2*d* is a corresponding illustration of the same tool string wherein the stroker unit (97) has displaced the injection aperture (34) to the perforation (43) made.

Figure 2E:
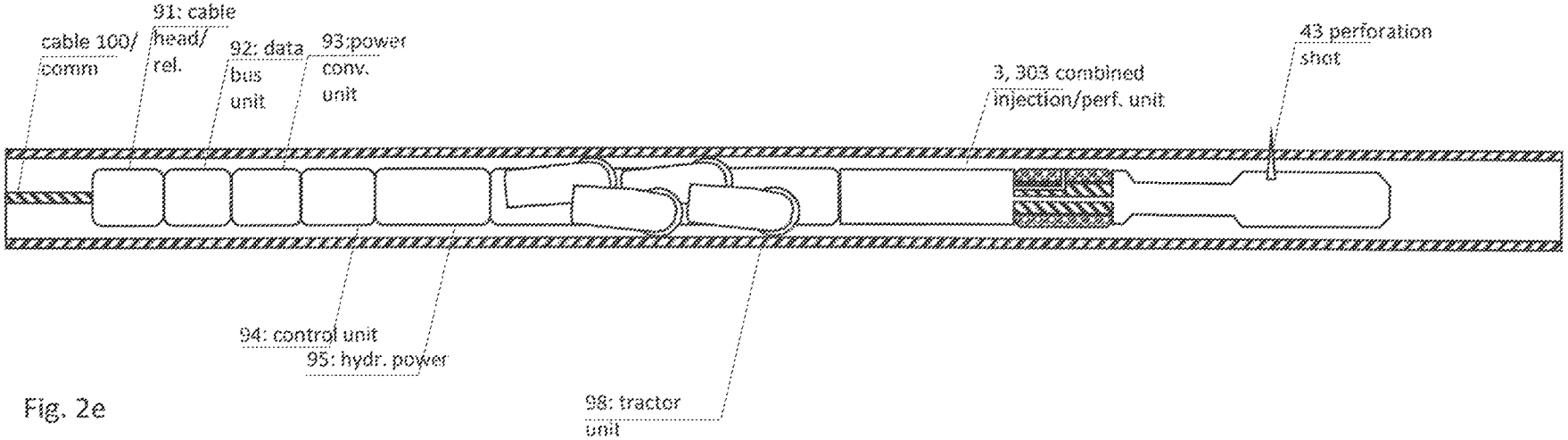

FIG. 2*e* is an illustration of a tool string on a cable (100), the tool string comprising a cable head and release unit (92), a data bus unit (92), an electrical power conversion unit (93), a tool control unit (94), a hydraulic power unit (95), a here shown engaged tractor unit (98), and the combined injector and perforation unit (3, 303) whereof the perforation unit (303) has made one perforation.

Figure 2F:
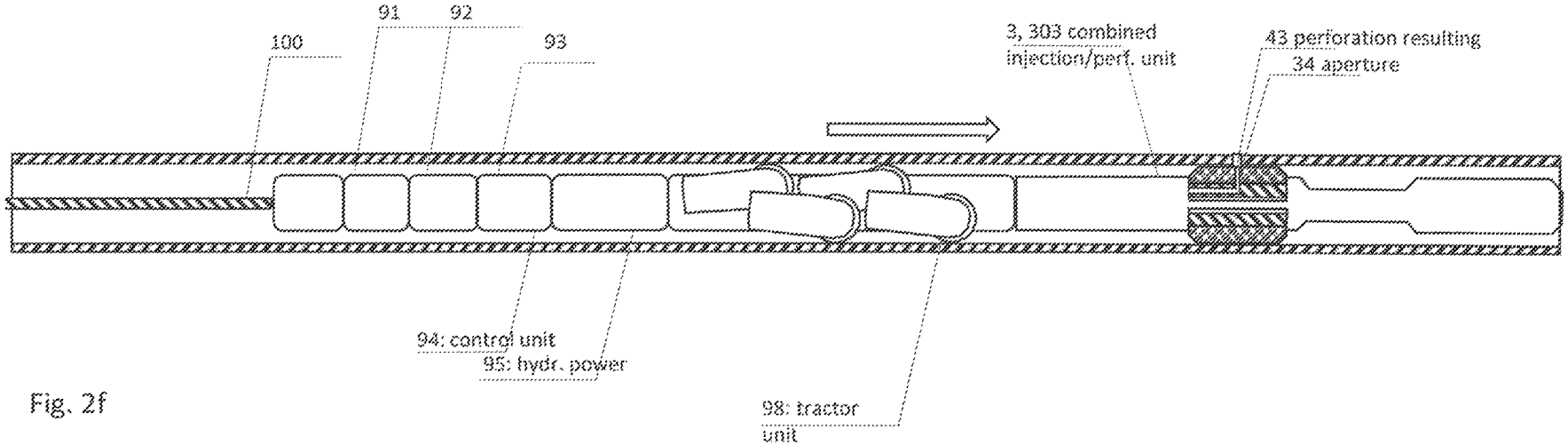

FIG. 2*f* is a corresponding illustration of the same tool string wherein the tractor unit (98) has advanced the entire tool along a required distance, and thus displaced the injection aperture (34) to the perforation (43) made before the aperture (34) is engaged with the inner face of the wall.

FIG. 3 is a subsequent situation after the perforation (43) has been formed, the wall engaging arm (33) with the aperture (34) now displaced and engaged with the wall of tubing (4) so the perforation (43) is isolated by a gasket about the aperture (34). A tracer (Tr)-doped fluid (1) dose (11) is pumped out of the aperture (34) and injected through the perforation (43) and builds up to form a deposition (12) on the outer tubing wall (41*o*) within the annulus when the fluid portion (11) sets. The deposition may occupy different proportions of the annulus both with regard to radial and angular coverage, please see below.

FIG. 3*b* is a longitudinal section of an injection tool comprising multiple polymer liquid containers (31, 31*i*). The figure illustrates two or more liquids (1, 1*i*) are arranged in one, two or more polymer liquid container(s) (31,31*i*) forming part of the annulus injection tool (3). In an embodiment of the invention liquids with different tracers may be arranged serially within the chamber and all arranged to be displaced in turn out through the nozzle.

FIG. 3*c* cross section of an injection tool comprising multiple liquid lines and engagement arms for delivering liquid to corresponding apertures in the tubing wall. An embodiment corresponding to this figure may also be combined with the illustration in the left and the two bottom figures of FIG. 3*b*. An embodiment of the invention may have multiple liquid lines and engagement arms for delivering liquid to corresponding apertures in the tubing wall connected to one or more containers, 31, . . . 31*i*. Further embodiments will have

- single cylinder, container and multiple pistons
- single cylinder, multiple doses longitudinally
- single cylinder—two or three parallel doses,
- series of independently operated cylinders with independent flow channels, liquid lines.

Figure 4:
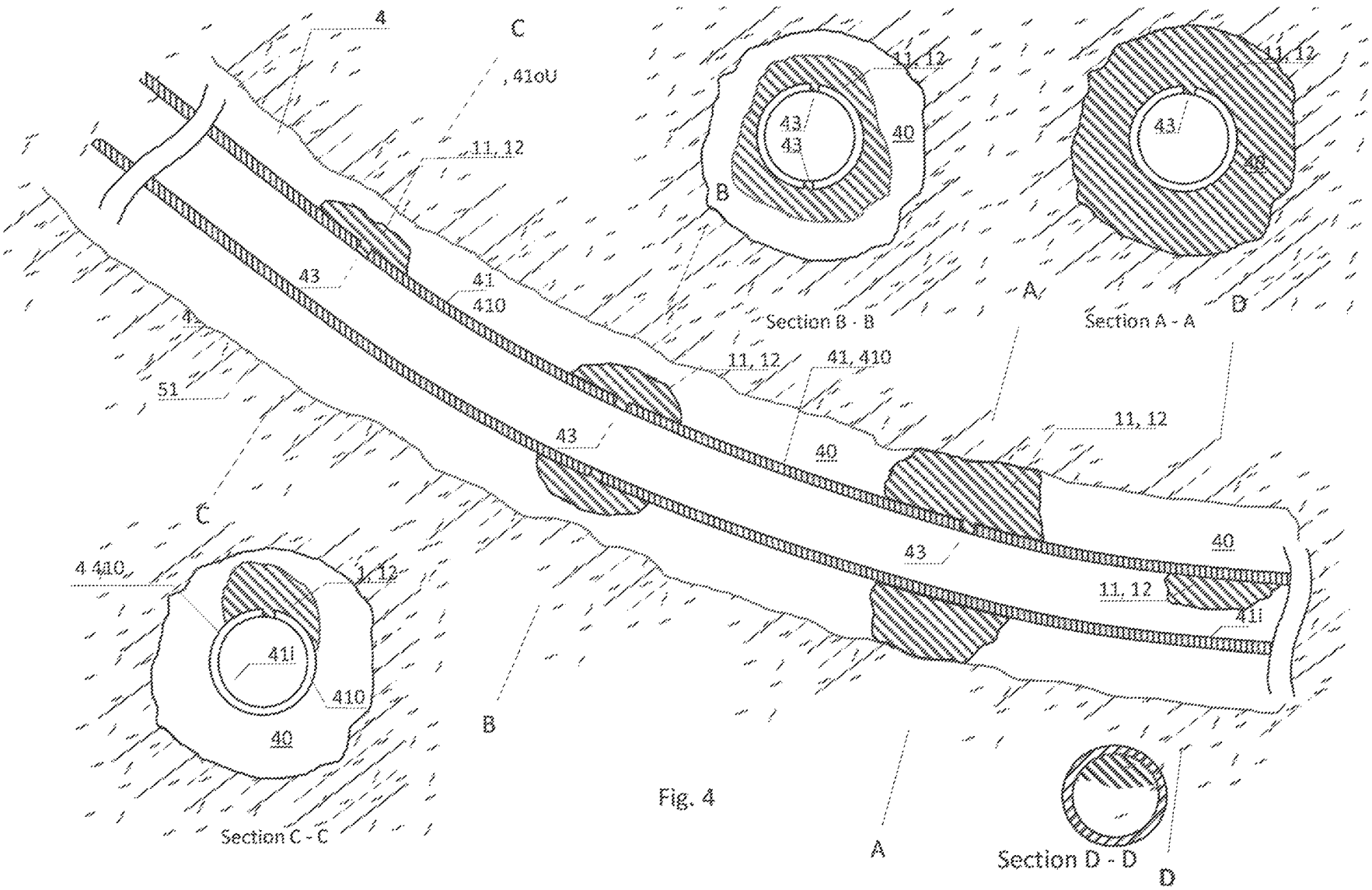

FIG. 4 is, in the diagonal middle portion of the sheet, a longitudinal section of different embodiments of a tracer deposition (12) formed on the tubing (41) wall.

At section A-A, a deposition (12) is formed on the outer surface (41*o*) of the tubing (4). The section A-A deposition fills the annulus (40) between the outer surface (41*o*) and the borehole wall (51). Note that a small portion of the deposition (12) will remain within the perforation (43) and may release a very small proportion of tracer (Tr) material directly to the tubing (4) bore main flow. Such a deposition may be said to fill the annulus both radially and circumferentially. Fluid passage along the annulus (40) is prevented if the deposition (12) is not permeable.

At section B-B, the deposition (12) is formed on the outer surface (41*o*) of the tubing (4), and is circumferentially covering, but not radially covering the annulus (40). Annular flow past the deposition is allowed.

At section C-C only a local, non-circumferential deposition (12) is formed on the outer surface (41*o*). Such a local deposition may be formed intentionally at either the upper or lower part of the surface (41*o*U, 41*o*L) of the tubing outer surface (41*o*) and may be oil or water-releasable according to the invention.

At section D-D a corresponding local internal deposition (12) is formed on the inner surface (41*i*) on the tubing (4) wall. In such a situation no perforation is required for making the deposition (12), but the feature of making a deposition at the inner face of the wall, either for forming a non-blocking tracer deposition (12) within the pipe as shown here, or a tubing (4) bore blocking deposition as shown in FIG. 7 below, or a combination of the two, is useful in embodiments of the present invention.

FIG. 5 is a cross section of a tubing (4) with an annulus (40) in a borehole (5) with an embodiment of an injection tool (3) according to the invention with two or more, here shown as three, wall engaging arms (33*a*, 33*b*, 33*c*) with apertures (34*a*, 34*b*, 34*c*) engaged with the inner wall of tubing (4) so the perforations (43*a*, 43*b*, 43*c*) are isolated by gaskets about the apertures (34*a*, 34*b*, 34*c*). Three preferably different tracer (Tr)-doped fluid (1) doses (11*a* 11*b*, 11*c*) are pumped out of the apertures (34*a*, 34*b*, 34*c*) and injected through the perforations (43*a*, 43*b*, 43*c*) and build up to form depositions (12*a*, 12*b*, 12*c*) on the outer tubing wall (41*o*) within the annulus when the fluid portions (11*a*, 11*b*, 11*c*) set. An orienting device for measuring, registering and optionally adjusting the rotational position for the combined perforation and injection apparatus (3, 303) would enable orienting the formed injected depositions (12*a*, 12*b*, 12*c*) in order to enable detection of water-releasable tracers in different positions in the annulus (40) about the tubing (4). The use of differently releasable tracers, such as water-releasable tracer depositions (12) in the lower part of a partly horizontal portion of the well would be highly useful for early detection of water or for assessment of the water cut along a particular section of the well. In an embodiment, not illustrated, a similar configuration is used but then connecting the, here illustrated three, engaging arms (33*a*, 33*b*, 33*c*) with the corresponding liquid lines to one single common container. Three doses (11*a* 11*b*, 11*c*) of the same tracer (Tr)-doped fluid (1) are then pumped out of the apertures (34*a*, 34*b*, 34*c*) and injected through the perforations (43*a*, 43*b*, 43*c*) and build up to form depositions (12*a*, 12*b*, 12*c*) on the outer tubing wall (41*o*). In an embodiment this also is used for delivering doses at the next position from another container when liquid lines are connected as illustrated in FIG. 3*b*, middle figure.

FIG. 6 is a longitudinal section through a well with a production tubing (4) having an annulus (40) and a tracer deposit (12) formed within a sand screen (ss) mesh without having to make any perforations (43) through the tubing wall (41) because they are already available in the sand screen portion of the tubing. An influx of fluid such as oil or gas from the reservoir passes across the deposition (12) within the screen and enters the main bore flow to contribute to the production flow so far in the stream. In the illustrated embodiment the tracer may be water-releasable to detect influx of water, be oil-releasable to monitor the production of oil, or a combination of two tracers (TrW, TrO) for detecting water intrusion and monitoring oil production.

FIG. 7 is a longitudinal section of an innermost portion of a production well usually called the "toe" (sic) of the well. Here is illustrated the face wall of the well, a so-called float shoe used while inserting and completing the production liner in the well. At least one production zone exists downstream, but is not shown here; otherwise, this portion is not perforated in the illustration before the method of the invention is applied. In order to block water influx indicated by (w), a water-releasable tracer deposit (12) is formed at the inner wall of the well (or even at the outer wall). Then an annular-filling deposit (12) is formed with the method of the invention, injecting through a formed aperture/perforation (43) in the liner wall, and further a liner bore blocking deposit (12) is made to seal off finally everything upstream illustrated. Hopefully now the water (w) in the annulus (40) and within the bore is blocked and prevented from passing the wall-to wall formed deposit combination (12, 12) to the left. Downstream detection in the production flow of the tracer here indicated as deposition (12*i*) will indicate a non-successful isolation of the blocked water mass (w).

FIG. 8 and FIG. 9 below illustrate opposite problems and corresponding opposite solutions: marking of desired petroleum production or detection of non-desired water production.

FIG. 8 illustrates a longitudinal cross section of a production liner (4) with an annulus (40) in a well (5), and production past a zonal isolated tracer. A deposition (12) is formed within isolated oil influx chamber formed in the annulus (40). In this way a so-called influx delay chamber is formed and which may be utilized accordingly. The influx oil will pass the formed tracer deposit (12) on its way through the annulus (40) and join the main bore production flow (01) as partial flow (02). Only gas or oil influx is desirable. The packers illustrated may in an embodiment be formed using the present tool, and one may mark each packer, particularly the downhole packer, with a tracer, too, or form non-tracer packers.

FIG. 9: is an illustration of a similar, but opposite situation compared to the FIG. 8 illustrated situation. Here we conduct water zone isolation using the method of the invention. A middle deposit (12) with tracer Tr(m) is only partially filling the annulus between an upstream annulus deposit (12) to the right and a downstream annulus deposit (12 to the left. Oil production occurs downstream, please see influx (o). If the Tr(m) is detected downstream, there is a leakage problem. This may occur if there is a leakage across the downstream annulus formed deposition (12)—formed packer or via a crack or permeable rock, which bypasses the downstream packer. If the downstream packer tracer Tr(d) is oil-releasable and detected downstream, then this is OK as such and indicating that the annulus below the downstream packer produces oil, but it doesn't preclude the detection of the leakage indicating tracer Tr(m) indicating leakage of water. This may be used to check whether the deposit (12, Tr(m)) formed is actually isolated within the intended isolated water influx chamber.

Figure 10:
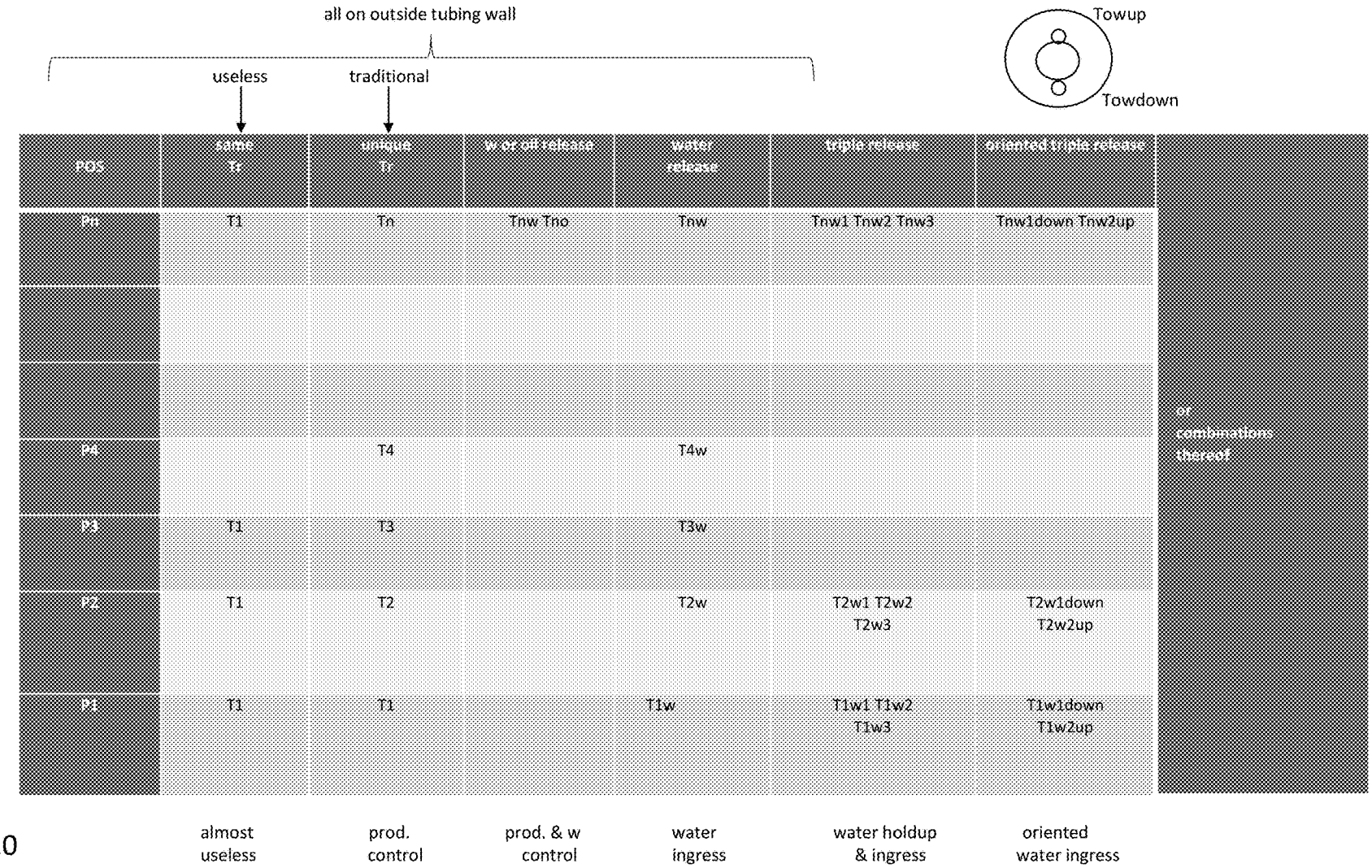

FIG. 10 shows a table of how different tracers (T1 . . . Ti) with different properties may be combined for different tracer sources for placing downhole the well at desired positions along a production tubing. Tw—affinity or releasable to water, To—affinity or releasable to oil. Combination with tracers designed for gas may also be used but is not illustrated in the table.

EMBODIMENTS OF THE INVENTION

The invention will in the following be described and embodiments of the invention will be explained with reference to the accompanying drawings.

The invention is a petroleum well tracer injection and monitoring method comprising the steps of

- providing a one or more curable liquid (1,1*i*) provided with one or more tracers (Tr, Tri),
- arranging said one or more liquid (1) in an intervention liquid injecting tool (3, 303)
- a)—running the injection tool (3) into a production tubing (4) in a petroleum well (5) to one or more desired injection position (P1,P2, . . . ) along the tubing (4) b)—actuating the injection tool (3) to apply one or more portions ($\mathbf{11}_1$, $\mathbf{11}_2$, . . . ) of the tracer doped liquid (1, 1*i*) at said one or more desired positions (P1, P2, . . . ), each said portion ($\mathbf{11}_i$) deposited to form a material deposition ($\mathbf{12}_i$) at a tubing wall (41) of said tubing (4) then allowing the well to produce, monitoring the tracers (Tr1, Tr2 . . . ) in the production flow (F), analyzing the occurrence of tracers qualitatively and/or quantitatively, and finally one may act on the basis of the analysis.

The tubing wall (41) has an inner surface (41*i*) and an outer surface (41*o*), see FIG. 2*a*. The tubing may be a casing, liner or any other production pipe in a petroleum production well. The method of placing the tracers may be used at any time after the casing, liner etc. is installed in a well, for instance after completion and before startup of production. A major advantage of the method is that it may be used as a retrofit tracer installation method. By curable it is to be understood that the material may settle, harden, stiffen, forming a more or less hard/solid state or/and to cure by a chemical reaction to form the material deposition 12. The deposition may become more or less hard, jelly like, porous, solid, firm or the like. For all embodiments, except from those where the deposit is set to have a sealing function, one could even use a liquid (1) forming a porous deposition (12).

An advantage of the method is that one may install tracers into the tubing and/or annulus after the well has been completed. The tracers may also be installed after a time of production and based on information from analysis of the well after a time of production as well. This gives the possibility of very well designed tracer sources for particular inflow zones etc.

The tracer (Tr, Tri) provided in the injection liquid (1) may comprise tracer molecules in a liquid state. The tracer could be in the solid form such as, grains, pellets, proppant, in the liquid polymer and designed for release to the passing flow. The tracers and, the tracer sources or the liquid (1) used, may be designed for release over time or on a change in conditions, such as water intrusion, oil intrusion or other physical or chemical changes. An advantages of the invention is that for wells that have run out of tracers or has not been installed with tracers, will be able to be monitored with regards to such changes. The positions (P, Pi) could be at different influx In an embodiment of the invention, one may move the tool (3, 103) to repeat the steps a-b on different desired positions (P1, P2, . . . ) in one run of the tool (3) into the well (5). I.e. one trip, multiple injections and retrieving the tool after all (two or more) injections are finished. An option is to drop the tool in the well after operation of one trip or multiple trips.

In an embodiment, we may inject the liquid portion ($\mathbf{11}_1$, $\mathbf{11}_2$, . . . ) through one or more apertures (43) in the tubing to form the one or more depositions (12*i*) outside the pipe/tubing (4) in the annulus (41).

In an embodiment of the invention, said deposition (12*i*, . . . ) is formed at an outer surface (41*o*) of said tubing wall (41), please see FIG. 4, section A-A, section B-B, section C-C. Placing portions of liquid outside the tubing wall requires an opening, aperture, hole, perforation through the tubing wall (4), either created prior to the injection, with an integrated perforation tool or, a separate connected tool at the tool string, or through an existing perforation, such as through a sand screen etc.

The tracers may be tailor-made in regard to viscosity, rheology and density, etc. In an embodiment of the method, the deposit formed effectively seals off unwanted fluid cross-flow behind liners, tubing and screens by placing a solid external annulus packer. In an embodiment the method and the tool according to the invention will be used to place a smaller volume of tracer doped polymer/liquid into the annulus, but will still enable bypass of fluid in the annulus. This is to aid in cloud development and diffusivity of the tracers.

A tool which could be used in the present invention may be the tool of US patent U.S. Pat. No. 9,045,975 B2 but the polymer will be provided with tracer material. However, the background US patent has only one container for its liquid, and is not arranged for multiple injections in one run, and is thus of limited use without major modifications.

The tracers can be designed to detect oil, water, gas, or any combination of these, please see FIG. 10 for possibilities of combinations. The tool can be designed with the following injection scenarios:

One perforation mechanism in one area, it may be a plurality of perforations, but in the annulus in one general position along the tubing, one injection. Where the polymer mix is homogenous.

One perforation mechanism, but capable of multiple perforations, and one injection with partial injection into each perforation.

One perforation mechanism, but capable of multiple perforations, with multiple injections from multiple polymer containers.

A plurality of perforation mechanisms, and single or multiple injections from single or multiple polymer containers which will enable two or more tracer placements per intervention.

The tool can be deployed for purposes of deploying annular barriers with tracers in the annulus only, non-annular barrier placement of tracers, or a combination of these. The combination can be placed either in one intervention trip, or a multiple of intervention trips.

The annulus can be open, gravel-packed, or natural sand packed.

In an embodiment the tool can be used to place tracer in the annulus through an existent perforation. Especially with an onboard CCL (Casing Collar Locator), it would be easy to detect an ICD (inflow control device) or an open sliding sleeve, and inject through it.

The injection could be into a screen through the perforations in the base pipe, or through slotted liner.

In an embodiment of the invention, if the tubing has not already been perforated, punctured, predrilled, slotted at said desired position (P1, P2, . . . ), then perforate the tubing wall (41) before applying the liquid (1).

According to an embodiment of the invention, one may conduct the perforation using a separate perforation tool (300), but it is highly advantageous to run the method perforating using a combined injection and perforating tool (303).

According to an embodiment of the invention, it is applied a portion (11*i*) of liquid (1) at one or more positions (Pi) along the tubing (4) so as for forming said deposition (12*i*) as a circumferential sealing deposition (12*i*, 121) in the annulus (41) between the tubing (4) and the surrounding borehole wall or subsequent casing. Please see FIG. 4. An advantage of this is the ability of monitoring the integrity of the plug by monitoring whether one or more of the unique tracers (Tr, Tri) occur in the production flow (F) or not, and also if desired the concentration thereof.

In an embodiment of the invention where a deposit is formed through the borehole a first portion ($\mathbf{11}_2$) of liquid ($\mathbf{1}_2$) is applied at first positions (P1) along the tubing (4) so as for forming a deposition (122) with one or more unique tracers (Tr1,Tr3, . . . , Tri) in the annulus (41), then a second portion ($\mathbf{11}_1$) of liquid ($\mathbf{1}_1$) is applied at a second positions (P1) downstream along the tubing (4), said second depositions (11*i*) forming a circumferential sealing deposition (12*i*) to form a zonal sealing plug with one or more other unique tracers (Tr2,Tr4, . . . , Tri) in the annulus (41) between the tubing (4) and the surrounding borehole wall or subsequent casing, then monitoring the integrity of the plug by monitoring qualitatively and/or quantitatively whether one or more of the unique tracers (Tr1,Tr3, . . . , Tri) occur in the production flow (F) or not.

One may also use the tool for applying the one or more portions (11*i*) of liquid (1,1*i*) inside the tubing (4), forming said deposition (12*i*, . . . ) at an inner surface of said tubing wall (41). In such a situation no perforation is required for making the deposition (12), but the feature of making a deposition at the inner face of the wall, either for forming a non-blocking tracer deposition (12), Please see FIG. 4, or a tubing (4) bore blocking deposition as shown in FIG. 7 and further described below, or a combination of the two, is useful in embodiments of the present invention. This will expose the tracer for the production flow flowing inside the tubing. Monitoring of tracer release from pre-defined positions along or/and in the circumference inside the tubing, together with other well information may give valuable information of the well. This may for instance be used to identify slip, hold up and zonal influx.

In an embodiment of the invention illustrated in FIG. 7, it is applied an amount of liquid (1) at one position across the bore of said tubing (4) inside the tubing so as for forming a polymer bridge plug (122) or a tubing plug. Two plugs could be pumped, the lower one, upstream of the upper one, with tracer (either for forming a non-blocking tracer deposition (12), or a tubing (4) bore blocking deposition, and the upper one right above it, with or without other tracers. Monitoring the production flow for the presence or not of the lower placed tracers, would verify that the toe of a well is isolated, and would be a slick way to run a retrofit plug that requires high expansion due to an upper restriction in a liner. Normally, an ECP (external casing packer) would be attempted for this application, but they are notoriously unreliable.

According to the invention, two or more liquids (1, 1*i*) are arranged in one or more polymer liquid container(s) (31,31*i*) forming part of the annulus injection tool (3), please see FIG. 3*b*. This is a common feature for all above embodiments. A very simple way of running the method could be to arrange the liquid in the intervention injecting tool all the way from the surface during operation, but this would require long lines and would be difficult to operate with a curable liquid. In an embodiment of the invention we arrange the liquid (1, 1*i*) in liquid containers (31, 31*i*) comprised by the tool (3) prior to lowering the tool into the well, please see FIGS. 2 and 3. Advantages is a lower risk of leakage and miss positioning of the portions (11*i*) and it will be a simple tool with few components extending from surface and down.

In an embodiment of the invention the liquid is pumped from the one or more container (31, 31*i*) via one or more liquid lines (32, 32*i*) via a one or more well engaging arm (33, 33*i*) to a corresponding outlet (34, 34*i*) aligned with an aperture (43) in the wall (40) of the tubing (4), all arranged for pumping one or more liquid portions (11, 11*i*) along the tubing wall (41) for forming the depositions (12, 12*i*) at the positions (P, Pi). Please see FIGS. 3, 3*b* and 5. There are several ways of utilizing the one or more containers and their corresponding liquid lines;

According to an embodiment one is arranging a volume (V, Vi) of each of two or more of the one or more liquids (1, 1*i*) in an applying sequence in one or more of the container (31,31*i*) in the intervention liquid injecting tool (3), the liquid (1, 1*i*) being doped with different tracers (Tr, Tri) and/or combinations of the tracers (Tr, Tri), Please see examples of combinations FIG. 10. There may be only one type of liquid with one or more tracers and only used one single container. This may deliver a portion (11, 11*i*) at only one position or a portion with equal properties and/or tracers at more positions (P, Pi) along the tubing. An alternative is to place different liquids, having rheology and viscosity properties allowing the liquids not to mix, in a sequence in a single container, please see FIG. 3*b* upper left, placing them one at a time along the positions (Pi) along the tubing (4). In this way one place portions with different properties and/or tracers at different positions along the tubing. Knowing the tracers and the positions, those embodiments may require and/allow different ways of analyzing the well.

According to an embodiment of the invention one may arrange the volume (V, Vi) of each of the one or more liquids (1,1*i*) in each appurtenant container (31, 31*i*), the liquid (1, 1*i*) being doped with different tracers (Tr, Tri) and/or combinations of the tracers (Tr, Tri). This will reduce the risk of mixing the liquids together, regardless rheology and viscosity properties. This also gives the advantage that one may for instance use half the volume ($V_1$) placing the first portion ($\mathbf{11}_1$), then using half the volume ($V_2$) placing the next portion, then using the rest of Vi placing the third portion, and so on. One does not have to deliver the liquids in the sequence they have in the containers.

In an embodiment this will result in one perforation mechanism perforating a position or pre-perforated position, one injection, but more than one tracer-carrying polymer is injected from the same injection operation. The tracers may be mixed in the polymer or there may be different tracers in different polymers, either in series stacked in the container or in parallel (similar to aquafresh toothpaste).

In an embodiment of the invention each liquid (1,1*i*) is applied from the each appurtenant container via an appurtenant arm (33, 33*i*) and outlet (34, 34*i*) to different sectors (PS, PSi) of the circumference of the tubing (4). Please see FIG. 5. In such an embodiment one will run the tool to have the perforation gun in desired position P1, rotate the gun and the injection tool (3,303) to orientate guns and injectors (a, b, c) in desired orientations, shoot to perforate, move injectors forward to perforations and then inject the liquid (11*a*, 11*b*, 11*c*). Orientated injected depositions (12*a*, 12*b*, 12*c*) will enable detection of for instance water-releasable tracers in different positions in the annulus (40) about the tubing (4). One may in this way monitor the distribution of oil, gas and water in a more or less horizontal part of the pipe.

The liquid used for the invention may be a curable liquid (1, 1*i*) such as a curable polymer liquid (1,1*i*). By curable it is to be understood that the liquid have the properties to harden, set, cure etc, under the well conditions.

In an embodiment the curable polymer liquid (1, 1*i*) is an epoxy, for forming solidified epoxy portions/depositions(12, 12*i*).

The polymer, which is used as the tracer substrate (tracer carrier matrix) can be uniquely designed for water, oil, gas, or a combination of these fluids. In other words, the polymer can contain multiple tracers that detect multiple fluids, or different polymers can contain single tracers, where each polymer is designed for a specific tracer to accentuate desired release rates. Please see illustration FIG. 10.

The method according to any embodiments of the invention may be conducted as a retrofit installation in an existing petroleum production well. This is a major advantage of the invention. One may also utilize the method for a well that is completed, but not yet producing. Monitoring may take place on any flow from the well.

Installation of tracers as described herein, may be performed without monitoring step, but the purpose of installing tracers is to at a possible stage or time, monitor i.e detect the tracers.

The tracer sources (T1, T2 . . . Ti) are formed by the one or more portions ($\mathbf{11}_1$, $\mathbf{11}_2$, . . . ) of the tracer doped liquid (1, 1*i*) forming a material deposition ($\mathbf{12}_i$). The liquid will be doped by one or more tracers which may be similar for different positions or unique for different positions. Eks Tr1 unique id and designed for water intrusion release, Tr2 different unique id and having affinity to oil, Tr3 another unique id for water intr rel, Tr4 a second different unique id and having affinity to oil. Then T1 may comprise Tr1 and Tr2 and T2 may comprise Tr3 and Tr4. Please see FIG. 10.

An advantage of the monitoring method is that the method enables placement of the tracers in discrete zones which enables qualitative verification and quantification of flow from each zone. The method does not require placement of any equipment into the wellbore. The process ensures future access to the well, enabling repeatability, assuming tracer life has expired, or if zones are modified, or even if the results are questionized. More polymer plugs can be pumped into the annulus, which changes the zone lengths and correlating contributions.

The invention is also an intervention tracer injecting tool (3) for placing of one or more portions of tracers sources (T1, T2, . . . ) to one or more desired injection position (P1,P2, . . . ) along a production tubing (4) in a petroleum well (5) comprising one or more liquid containers (31, 31*i*) with one or corresponding liquid outlets (34, 34*i*) and one or more well engaging means (33, 33*i*) having a corresponding isolating gasket (35, 35*i*)

one or more actuator means (36) arranged for activating one or more delivery means (37, 37*i*) for delivering one or more portions (11, 11*i*) of one or more tracer doped liquids (1, 1*i*) forming deposits (12, 12*i*) of tracer sources (T1, T2, . . . ) at the desired positions (P1, P2 . . . ) along the tubing (4) and/or to different sectors (PS, PSi) of the circumference of the tubing (4).

In an embodiment for placing tracers in a pre-perforated, slotted or the like, tube (4), such as to a sand screen etc, the gaskets (35) will be of a larger type than for the embodiment with a perforating tool. Since the perforations then are everywhere, one may then place the larger gaskets, pads, just to ensure that a perforation is definitely captured by the gasket and a portion will be correctly delivered.

The intervention can be wireline, electric-line, coiled tubing, carbon fiber rod, hydraulic workover unit, or rig-based. It can also be autonomous, battery operated deployed as a pumpable dart or drop system, and remotely actuated by timer or environment such as pressure, temperature, salinity etc., then retrieved via intervention. The tool is designed for placing tracers in one or more desired position in a well after completion, and a major advantage is that it may be used as a retrofit method. Another advantage is that it has pumping systems and actuators facilitating delivery of one or more portions of a tracer containing liquid. Advantageously there is more than one liquid line and outlet from the one or more containers. In an embodiment one container may also have more liquid lines to deliver portions of the same tracer source in different sectors around the circumference of the tubing or to enable the portions to envelope the total outer or inner surface of the tubing without creating a total seal or plug, See FIG. 4, section B-B.

In an embodiment of the invention the one or more liquid lines (32, 32*i*) each from a corresponding one or more liquid container (31, 31*i*) to each of the corresponding liquid outlets (34, 34*i*) is arranged. This is an advantage allowing the tool to carry and deliver even more than one type of liquid. Please see FIGS. 2*a*, 3, 3*b* and 5. The containers may be arranged in series or in parallel. With a common liquid line to the outlet (34) or with a corresponding line and outlet for each container.

According to the invention the tracer injecting tool is arranged with one or more well engaging means (33, 33*i*) .The well engaging means may be engaging arms, Please see FIG. 1, comprising the liquid lines or an expandable compartment, please see FIGS. 3 and 5 comprising the liquid lines etc, facilitating engagement of the outlets to the perforated holes in the tubing wall. The tool becomes a high precision tool with little risk for delivering the portion of liquid outside the intended hole.

In an embodiment of the invention the actuator means (36) being programmed to actuate on preset intervals and will be a part of the tool control unit (94). Control system internal in the tool, a tool control unit (94) and top side units and communication lines to surface, is known as such.

The tool may also be equipped with actuator means (36) having a control line (38,100)) to top side the intervention rig to a remote control unit (39). Please see FIGS. 1, 2*c* and 2*d*.

According to the invention the injecting tool containers (31, 31*i*) are arranged to hold an appurtenant liquid (1, 1*i*) being doped with different tracers (Tr, Tri) and/or combinations of the tracers (Tr, Tri).

In an embodiment of the invention the injecting tool comprises a perforation tool (300) thus forming a combined injection and perforating tool (303). Having the perforation tool as an integrated part of the injecting tool is an advantage in respect of alignment of the equipment. The accurate distance between the perforation tool position and the liquid outlets (34, 34*i*) is known, which facilitate exact delivery of liquid during operation of the tool in the well. It also limit the numbers of intervention run into the tubing.

In an embodiment the combined perforation and injection tool (3, 303) is provided with an anchor (96) and a stroker (97) for anchoring the combined tool (3, 303) before perforation and moving the aperture (34) to the perforation (43).

According to an embodiment of the injecting tool, alignment means (97, 333) for aligning the engaging means (33, 33*i*) with the perforated holes (43) in the tubing (4), are arranged. This may be just preset traveling values based upon the known dimensions of the tool moving the whole tool, e.g. when the intervention tool is borne on a tractor unit. In another embodiment, e.g. when the tool is carried by a wire line etc this alignment means is part of the stroker unit (97). See FIGS. 2*c* and 2*d*.

In another embodiment the tool may be anchored before perforating, then a telescoping type unit, stroker, or the like, moving the injection part with the liquid outlets forward to the perforated hole.

In an embodiment the injecting tool according to the invention comprises an orientation means (334), such as a libelle or a spirit level instrument, connected to the injection tool (3) and means for sending information from the orientation mean (334) via the control line (38) to the remote control unit (39). This is arranged for orientation information together with tracer information for further well analysis and/or to rotation control of the injection and perforation apparatus (303) so that one may ensure correct placing of the different tracers when delivering liquid portions in different sectors as described above.

The invention claimed is:

1. A petroleum well tracer injection method comprising the steps of:

providing one or more curable liquids doped with one or more tracers, wherein the one or more curable liquids is an epoxy;

arranging said one or more liquids in an intervention liquid injecting tool;

running the injection tool into a production tubing in a petroleum well to one or more desired injection positions along the tubing;

actuating the injection tool to apply one or more portions of the tracer doped liquid at said one or more desired positions, each said portion deposited to form a material deposition at a tubing wall of said tubing;

applying a portion of liquid at one or more positions along the tubing so as for forming said deposition as a circumferential sealing deposition to form a zonal sealing plug with one or more unique tracers in the annulus between the tubing and the surrounding borehole wall or subsequent casing;

allowing the deposition to cure;

allowing the well to produce;

monitoring the tracers in the production flows;

analyzing the occurrence of tracers qualitatively and/or quantitatively; and monitoring the integrity of the plug by monitoring whether one or more of the unique tracers occur in the production flow and the concentration thereof.

2. The method of claim 1, further comprising the step of repeating the steps of running and actuating to the different desired positions in one run of the tool into the well.

3. The method of claim 2, further comprising the step of injecting said one or more portions through one or more apertures in the tubing to form the one or more depositions outside the pipe/tubing in the annulus.

4. The method according to claim 2, further comprising the step of applying the one or more portions of liquid inside the tubing, forming said deposition at an inner surface of said tubing wall.

5. The method according to claim 2, further comprising the step of arranging said liquid in said one or more polymer liquid containers forming part of the annulus injection tool.

6. The method of claim 1, further comprising the step of injecting said one or more portions through one or more apertures in the tubing to form the one or more depositions outside the pipe/tubing in the annulus.

7. The method according to claim 6, further comprising the step of forming said deposition at an outer surface of said tubing wall.

8. The method of claim 6, wherein if the tubing has not already been perforated, punctured, predrilled or slotted at said desired position, then the method further comprising the step of perforating the tubing wall before applying the liquid.

9. The method of claim 8, further comprising the step of perforating using a separate perforation tool.

10. The method of claim 8, further comprising the step of perforating using a combined injection and perforating tool.

11. The method according to claim 6, further comprising the steps of:

applying a first portion of liquid at a first position along the tubing so as for forming a deposition with one or more unique tracers in the annulus;

then applying a second portion of liquid at a second position downstream along the tubing so as for forming a deposition as a circumferential sealing deposition to form a zonal sealing plug with one or more other unique tracers in the annulus between the tubing and the surrounding borehole wall or subsequent casing; and monitoring the integrity of the plug by monitoring qualitatively and/or quantitatively whether one or more of the unique tracers occur in the production flow.

12. The method according to claim 11, further comprising the step of applying an amount of liquid at one position on the inner surface across the bore of said tubing inside the tubing so as for forming a polymer bridge plug.

13. The method according to claim 1, further comprising the step of applying the one or more portions of liquid inside the tubing, forming said deposition at an inner surface of said tubing wall.

14. The method according to claim 13, further comprising the step of applying an amount of liquid at one position on the inner surface across the bore of said tubing inside the tubing so as for forming a polymer bridge plug.

15. The method according to claim 1, further comprising the step of arranging said liquid in one or more polymer liquid containers forming part of the annulus injection tool.

16. The method according to claim 15, further comprising the step of pumping said liquid from said one or more containers via one or more liquid lines one or more well engaging arms to a corresponding outlet aligned with an aperture in the wall of the tubing, all arranged for pumping one or more liquid portions along the tubing wall for forming said depositions at the positions.

17. The method according to claim 15, further comprising the step of arranging a volume of each of two or more of said one or more liquids in an applying sequence in said one or more containers in said intervention liquid injecting tool, said liquid being doped with different tracers and/or combinations of said tracers.

18. The method according to claim 17, further comprising the step of arranging said volume of each of said one or more liquids in each appurtenant container, said one or more liquids being doped with different tracers and/or combinations of said tracers.

19. The method according to claim 1, further comprising the step of applying said each liquid from each appurtenant container via an appurtenant arm and outlet to different sectors of the circumference of said tubing.

20. The method according to claim 1, further comprising the step of conducting the steps as a retrofit installation in an existing petroleum production well.

21. An intervention tracer injecting tool for placing of one or more portions of tracer sources to one or more desired injection positions along a production tubing in a petroleum well comprising:

one or more liquid containers with one or more corresponding liquid outlets;

one or more well engaging means having a corresponding isolating gasket; and one or more actuator means arranged for activating one or more delivery means for delivering one or more portions of one or more tracer doped liquids forming deposits of tracer sources at the desired positions along the tubing and/or to different sectors of the circumference of the tubing; and for applying a portion of liquid at one or more positions along the tubing so as for forming said depositions as a circumferential sealing deposition to form a zonal sealing plug with one or more unique tracers in the annulus between the tubing and the surrounding borehole wall or subsequent casing.

22. The intervention tracer injecting tool according to claim 21, arranged with one or more liquid lines each from a corresponding one or more liquid containers to each of the corresponding liquid outlets.

23. The intervention tracer injecting tool according to claim 21, wherein the actuator means are programmed to actuate on preset intervals.

24. The intervention tracer injecting tool according to claim 21, wherein the actuator means having a control line to top side the intervention rig to a remote control unit.

25. The intervention tracer injecting tool according to claim 21, wherein each of the containers is arranged to hold an appurtenant liquid being doped with different tracers and/or combinations of the tracers.

26. The intervention tracer injecting tool according to claim 21, further comprising a perforation tool thus forming a combined injection and perforating tool.

27. The intervention tracer injecting tool according to claim 21, further comprising alignment means for aligning the engaging means with the perforated holes in the tubing.

28. The intervention tracer injecting tool according to claim 21, further comprising rotation orientation means connected to the injection tool and means for sending information from the orientation means via the control line to the remote control unit.

* * * * *